US009382608B2

(12) United States Patent
Blaauw et al.

(10) Patent No.: US 9,382,608 B2
(45) Date of Patent: Jul. 5, 2016

(54) METHOD FOR MANUFACTURING A STAINLESS STEEL PRODUCT

(75) Inventors: Hubert Sjoerd Blaauw, Drachten (NL); Martin Hommes, Drachten (NL); Lucius Theodorus Vinkenvleugel, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 924 days.

(21) Appl. No.: 11/917,577

(22) PCT Filed: Jun. 12, 2006

(86) PCT No.: PCT/IB2006/051861

§ 371 (c)(1), (2), (4) Date: Jul. 8, 2008

(87) PCT Pub. No.: WO2006/134541

PCT Pub. Date: Dec. 21, 2006

(65) Prior Publication Data

US 2009/0218011 A1 Sep. 3, 2009

(30) Foreign Application Priority Data

Jun. 15, 2005 (EP) ..... 05105275

(51) Int. Cl.
*C23C 8/26* (2006.01)
*C23C 8/24* (2006.01)
(Continued)

(52) U.S. Cl.
CPC . *C23C 8/26* (2013.01); *C21D 6/002* (2013.01); *C23C 8/80* (2013.01)

(58) Field of Classification Search
None
See application file for complete search history.

(56) References Cited

U.S. PATENT DOCUMENTS 2,238,278 A * 4/1941 Moskovics et al. ..... 30/43.6
3,943,010 A 3/1976 Hartline
5,503,687 A * 4/1996 Berns ..... 148/230
(Continued)

FOREIGN PATENT DOCUMENTS

EP 1533395 * 2/2004 ..... C23C 8/26
EP 1533395 5/2005
(Continued)

OTHER PUBLICATIONS

Funatani and Totten eds., Heat Treating, ASM (2000).*
(Continued)

*Primary Examiner* — Yoshitoshi Takeuchi

(57) ABSTRACT

The invention relates to a method for making a thin finished product to be formed by deformation that combines strength with resistance to a highly corrosive environment. The method comprises forming a sheet of stainless steel with a microstructure consisting predominantly of ferrite, austenite, martensite or a mixture thereof, with a thickness of less than 3 mm, to a three dimensional semi finished product, treating said semi finished product with a nitrogen-containing atmosphere at a temperature of between 1000° C. and 1200° C. during a time and under a nitrogen pressure, sufficient to saturate the product through the thickness with a nitrogen content between a lower limit of 0.3 wt % and an upper limit that is provided by the beginning of nitride separation, cooling down said product at such a rate and nitrogen pressure that nitride separation is avoided, and subsequently machining the nitrogen saturated semi- finished product to the finished product. The invention further relates to a rotary shaving assembly prepared by the method of the invention.

7 Claims, 1 Drawing Sheet

(51) Int. Cl.
*C21D 6/00* (2006.01)
*C23C 8/80* (2006.01)

(56) References Cited

U.S. PATENT DOCUMENTS

| | | | | |
|---|---|---|---|---|
| 6,531,007 | B1 | 3/2003 | Nilsson | |
| 6,811,581 | B2 * | 11/2004 | Yamada et al. | 51/307 |
| 2003/0096060 | A1 | 5/2003 | Trankiem | |
| 2005/0236070 | A1 * | 10/2005 | Blaauw et al. | 148/222 |

FOREIGN PATENT DOCUMENTS

| | | | | |
|---|---|---|---|---|
| JP | 2002-194504 | * | 7/2002 | C22C 38/00 |
| JP | 2002194504 | | 7/2002 | |
| WO | 2004013367 | | 2/2004 | |
| WO | 2004015159 | | 2/2004 | |

OTHER PUBLICATIONS

English translation of JP 2002-194504 (2002).*
Berns: "Case Hardening of Stainless Steel Using Nitrogen" http://www.insutrialheating.com/CDA/ArticleInformation/features/BNP__Features__Item/0,2832,99594,00.html.
Toro: "Improvement of Corrosion-Erosion Resistance of Martensitic Stainless Steels by Nitrogen Addition at High Temperature" http:www.prnt.usb.br/ACADEMIC/antschip/Inprovement%20of%20Corrosion-Erosion%20Resistance%20.pdf.

* cited by examiner

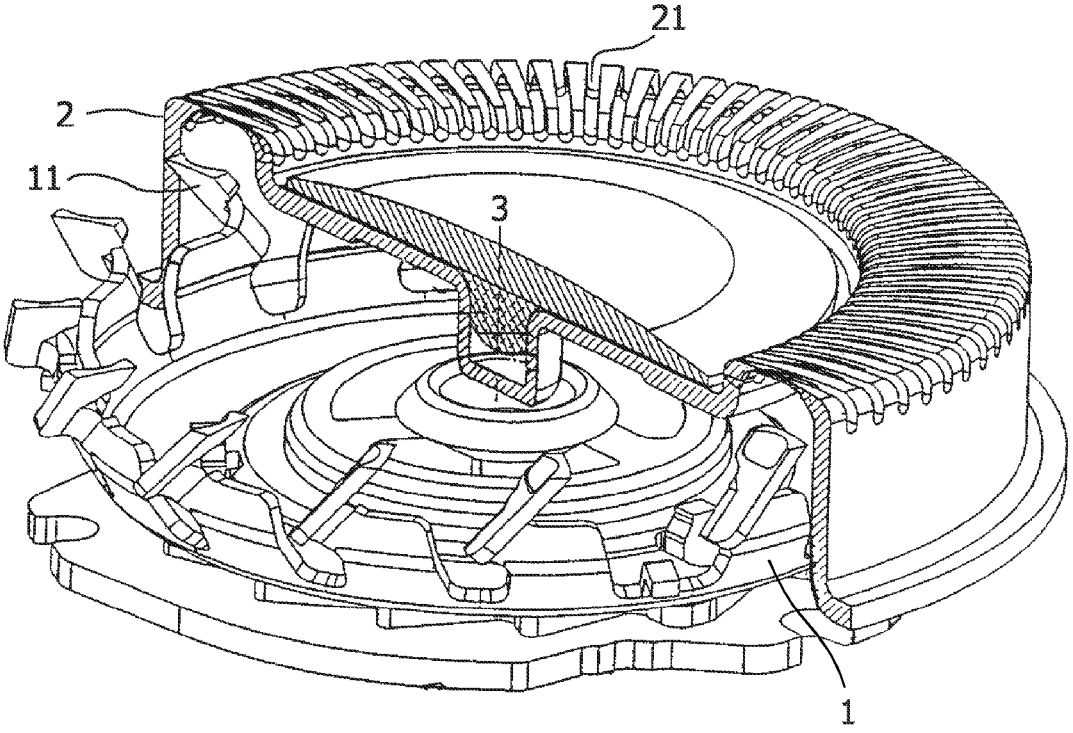
21
2
11
3
1

METHOD FOR MANUFACTURING A STAINLESS STEEL PRODUCT

FIELD OF THE INVENTION

The invention relates to a method for the manufacturing of a thin three dimensional steel product by deformation. A thin three dimensional product is understood to be a product having an envelope, whose dimensions in three perpendicular directions exceed a largest thickness of the product, this largest thickness being less than 3 mm, preferably less than 1 mm. Deformation for example can include methods like deep drawing or stamping.

Examples of these thin three dimensional products are a rotary cutter and shear plate of a cutting assembly of an electric rotary-shaver apparatus. Some recent models of rotary-shavers are used with shaving cream and can be rinsed with running water. This requires a steel type for the cutting assembly that not only combines strength with formability, but that should also resist a highly corrosive environment.

The invention further relates to a thin three dimensional product that is resistant against such a highly corrosive environment.

BACKGROUND OF THE INVENTION

A method for the manufacturing of a shaver cap is e.g. known from U.S. Pat. Nos. 6,531,007. 6,531,007 describes deep drawing of a steel sheet of a particular composition to obtain the necessary bowl shape for the shaver-cap. The particular steel composition of U.S. Pat. No. 6,531,007 (Sandvik 1RK91 steel), comprises 4 wt % of Mo. With this composition a balance is achieved between formability and hardenability, i.e. its capacity to be heat-treated to a certain strength. The resulting shaver cap exhibits excellent properties with respect to wear, corrosion resistance and hardness.

Due to its 4 wt % of Mo, the Sandvik 1RK91 steel is significantly more expensive than martensitic stainless steels like AISI 403, AISI 410, AISI 420, X32Cr14 and X38CrMo 13. These commodity steels however are less resistant to corrosive environments than the Sandvik 1RK91 steel.

Therefore, there is a need for an alternative method the manufacturing of a thin three dimensional steel product to be formed by deformation that combines strength with resistance to a highly corrosive environment.

SUMMARY OF THE INVENTION

Purpose of the invention is to provide a less expensive method for the manufacturing of a thin three dimensional steel product by deformation combining strength with resistance to a highly corrosive environment.

To achieve this object, the invention provides a method described by the features of claim 1.

In the method of the invention the recognition is utilized that saturation of a thin three dimensional product with nitrogen, hereinafter referred to as solution nitriding, need not to be limited to the surface and near surface regions, but may extend through the thickness of a shaped product. This allows subsequent machining to manufacture a complicated structured finished product that as such would not resist a temperature of more than 1000° C. required for the solution nitriding process. A particular advantage of solution nitriding is that it improves the resistance to local kinds of corrosion like intercrystalline corrosion, pitting and crevice corrosion.

Solution nitriding as a process to improve the corrosion resistance is known e.g. from U.S. Pat. Nos. 5,503,687. 5,503, 687 describes a process to improve the resistance of stainless steel to corrosion from moisture on a nearly finished product. Due to the fact that nitrogen enrichment in U.S. Pat. No. 5,503,687 is limited to a surface layer the semi finished products cannot be subjected to machining, like cutting and drilling, deeper than the inwards diff-used layer thickness without exposing untreated material.

A further disadvantage of this technique is that it cannot be applied to a thin three dimensional semi finished product that nearly has its final shape as this would not resist the high temperatures with regard to retaining its dimensional accuracy.

On the other hand, once a steel sheet is solution nitrided, forming a shaped product thereof by deformation is excluded because of its increased yield strength.

In the method of the invention a sheet of stainless steel with a microstructure consisting predominantly of ferrite, austenite, martensite or a mixture thereof, with a thickness of less than 3 mm is formed to a three dimensional shaped product. A thickness of less than 3 mm and preferably less than 1 mm is essential, because a thermodynamic equilibrium in the nitriding process should be obtained throughout the whole thickness of the shaped product. Without reaching this equilibrium through the thickness, the final machining to the finished product is limited to a surface treatment as it is in U.S. Pat. No. 5,503,687. An advantage of the present invention is that the subsequent machining is not limited to a surface treatment, but allows drilling and cutting without destroying the corrosion resistance obtained by the solution nitriding process.

Solution nitriding comprises a thermal treatment in a nitrogen-containing gas atmosphere at a temperature of between 1000° C. and 1200° C. The temperature, pressure and duration of the nitrogen enrichment are selected in such a way that a nitrogen saturation throughout the thickness of the shaped product is obtained, with the nitrogen content being between a lower limit of 0.3% by weight and an upper limit that is provided by the beginning of nitride separation during the nitrogen enrichment. A suitable partial nitrogen pressure to carry out the thermal treatment is between 0.01 and 0.3 MPa, preferably, at about 0.1 MPa.

The subsequent cooling is effected at such a rate and nitrogen pressure that nitride separation is avoided. This can e.g. be realized by recirculation gas quenching under a nitrogen pressure set in a range between at least the partial nitrogen pressure at which the thermal treatment is carried out and 2 MPa, at a cooling rate of at least 5° C./sec until a temperature of 20° C. is reached.

Optionally, the shaped product may be tempered to release built in stresses and to stabilise the microstructure at the tempering temperature. Preferably tempering is carried out by subjecting the finished product at a temperature of between 650° C. and 100° C., preferably between 200° C. and 100° C., during a time sufficient to release at least part of internal stresses, to a nitrogen pressure of at least the pressure at which the semi-finished product has been treated with the nitrogen-containing atmosphere. About 1 hour at 170° C. is a suitable condition for an adequate tempering procedure.

Subsequently the nitrogen-saturated shaped product is machined to the three dimensional steel product. This can be done by drilling, cutting, electrochemical machining or electro-discharge machining.

The invention further relates to a three dimensional steel product with a microstructure consisting predominantly of ferrite, austenite, martensite or a mixture thereof, with a thickness of less than 3 mm saturated throughout the thickness with nitrogen content between a lower limit of 0.3 wt % and an upper limit that is provided by the beginning of nitride separation. Preferably the invention relates to a product according to the invention, wherein the thickness is less than 500 μm. These products could not be obtained with sufficient dimensional accuracy by the method described in U.S. Pat. No. 5,503,687.

An additional advantage of a product according to the invention is that its hardness can be up to 50% more than the hardness of Sandvik 1RK91 steel.

Examples of these products are a rotary shaving assembly comprising a rotary cutter and shear plate, a cutter of an electric vibra-shaver, a cutter and comp or guard of a hair trimmer, the disks of an epilator, strongly shaped knife of a food processor and a strongly folded return spring for a thermostat in an iron.

It has unexpectedly been found that a product according to the invention exhibits a more than tenfold abrasion resistance than a product made from Sandvik 1RK91 steel. Therefore a product according to the invention is not only less expensive but also more resistant to abrasion. Therefore the method according to the invention is particularly suitable or manufacturing a rotary shaving assembly comprising a rotary cutter and a shear plate.

BRIEF DESCRIPTION OF THE DRAWINGS

FIG. 1 shows an assembly of a rotary shaving apparatus.

DESCRIPTION OF THE PREFERRED EMBODIMENTS

The assembly of the rotary shaving assembly in FIG. 1 consists of a rotary cutter 1 and a shear plate 2. The rotary cutter comprises a cutter disc along which periphery cutter blades are offset from the plane of the disc. The blades are arranged in an annular configuration along the periphery, symmetrical relative to a central axis 3.

The shear plate 2 was stamped from a sheet of martensitic stainless steel (X32Cr14) with a thickness of 400 μm. The thus formed three dimensional semi finished cup was solution nitrided at 1100° C. subsequently during 14 minutes at a nitrogen pressure of 0.093 MPA and 28 minutes at a nitrogen pressure of 0.043 MPa, until saturation throughout the thickness with nitrogen was reached. Recirculation gas quenching was applied under 1 MPa nitrogen gas pressure, during which cooling between 1100° C. and about 450° C. is carried out at a speed of about 25° C./sec. Tempering was done at 170° C. for 60 minutes under a nitrogen pressure of 0.2 MPa. Subsequently the shaving face is machined by electrochemical machining comprising the removal of about 150 μm material thicknesses followed by electrochemical machining of the running groove comprising the removal of about 100 μm material thicknesses. Then hair-entry apertures were cut in the circumferential direction, symmetrical with respect to a central axis 3. The nitrogen content of the resulting shear plate was about 0.4 wt %. The hardness of the resulting shear plate was 750 HV. The hardness of a similar shear plate made from Sandvik 1RK91 steel was limited to just 450 HV.

The rotary cutter 1 was stamped from a sheet of X32Cr14 with a thickness of 300 μm. The thus formed thin three dimensional semi finished product was solution nitrided at 1100° C., subsequently during 8 minutes at a nitrogen pressure of 0.093 MPa and 16 minutes at a nitrogen pressure of 0.043 MPa, such that it was saturated throughout the thickness with nitrogen. Recirculation gas quenching was applied under 1 MPa nitrogen gas pressure, during which cooling between 1100° C. and about 450° C. is carried out at a speed of about 25° C./sec. Tempering was done at 170° C. for 60 minutes under a nitrogen pressure of 0.2 MPa. Subsequently matching of the running faces with the running groove of the shear plate is done by electro-discharge machining of the ends of the cutter legs. The nitrogen content of the resulting rotary cutter was about 0.4 wt %. The hardness of the resulting rotary cutter was 750 HV. The hardness of a rotary cutter made from Sandvik 1RK91 was limited to just 575HV.

Due to the fact that these three dimensional semi finished products were saturated throughout the thickness with nitrogen, they could be machined to finished products while keeping their resistance to a highly corrosive environment also at all machined surfaces.

When solution nitriding of the rotary cutter and the shear plate is applied in their nearly final shapes, so after machining of the cutter legs respectively the running groove, both products loose their dimensional accuracy required to match the running faces of the rotary cutter with the running groove of the shear plate.

The corrosion resistance of the solution nitrided shaver cap was compared with a shaver cap made from Sandvik 1RK91 steel by immersing the caps in a 2 wt % NaCl solution of a ethanol/demi water (80:20) mixture. After 168 hours no corrosion could be observed. Martensitic steel caps that were not solution nitrided exhibited a significant corrosion after 168 hours.

The invention claimed is:

1. A method for making, a rotary shaving assembly, wherein the method comprises:

forming, by deformation, a sheet of stainless steel with a thickness of less than 3 mm and a microstructure consisting of ferrite, austenite, martensite or a mixture thereof into a three dimensional shaped product;

treating the formed sheet of stainless steel with a nitrogen-containing atmosphere at a temperature of between 1000° C. and 1200° C. during a first time and under a first nitrogen pressure sufficient to saturate the sheet of stainless steel through the thickness thereof with a nitrogen content between a lower limit of 0.3 wt % and an upper limit that is provided by the beginning of nitride separation, wherein the first nitrogen pressure is between 0.01 and 0.093 MPa;

cooling down the formed sheet of stainless steel at a rate of at least 5° C/sec and a second nitrogen pressure selected so that nitride separation is avoided; and subsequently machining the nitrogen saturated shaped sheet of stainless steel into a rotary shaving assembly including a rotary cutter and a shear plate.

2. The method as claimed in claim 1, wherein the sheet of stainless steel is tempered after the cooling down step and before the machining step.

3. The method according to claim 2, wherein tempering is carried out by subjecting the stainless steel sheet at a temperature of between 650° C. and 100° C. and during a second time sufficient to release at least part of internal stresses, to a third nitrogen pressure of at least the first nitrogen pressure.

4. The method of claim 1, further comprising quenching the stainless steel sheet via recirculation gas at a forth nitrogen pressure between 1.0 and 2.0 MPa.

5. The method of claim 3, wherein the third nitrogen pressure is between 0.01 and 0.3 MPa.

6. The method of claim 1, wherein the first time is at least 8 minutes.

7. The method of claim 3, wherein the temperature of tempering is between 200° C. and 100° C.

* * * * *